US006356731B1

(12) United States Patent
Shinjo

(10) Patent No.: US 6,356,731 B1
(45) Date of Patent: Mar. 12, 2002

(54) IMAGE FORMING METHOD AND APPARATUS

(75) Inventor: Yasushi Shinjo, Kawasaki (JP)

(73) Assignee: Kabushiki Haisha Toshiba, Kawasaki (JP)

( * ) Notice: Subject to any disclaimer, the term of this patent is extended or adjusted under 35 U.S.C. 154(b) by 0 days.

(21) Appl. No.: 09/641,827

(22) Filed: Aug. 18, 2000

(30) Foreign Application Priority Data

Aug. 23, 1999 (JP) ..... 11-235669

(51) Int. Cl.[7] ..... G03G 13/00; G03G 15/16

(52) U.S. Cl. ..... 399/297; 399/307; 399/308; 399/390; 430/126

(58) Field of Search ..... 399/297, 307, 399/308, 159, 388, 390; 347/153, 155, 185, 186, 187; 430/124, 126

(56) References Cited

U.S. PATENT DOCUMENTS

| | | | | |
|---|---|---|---|---|
| 5,148,222 A | | 9/1992 | Lior et al. | 399/233 |
| 5,166,734 A | | 11/1992 | Pinhas et al. | 84/607 |
| 5,208,637 A | | 5/1993 | Landa | 399/120 |
| 5,446,527 A | * | 8/1995 | Yasuda et al. | 399/307 |
| 5,629,761 A | * | 5/1997 | Theodoulou et al. | 399/307 |
| 5,650,253 A | | 7/1997 | Baker et al. | 430/119 |
| 5,689,786 A | * | 11/1997 | Tokunaga et al. | 399/307 |
| 6,078,776 A | * | 6/2000 | Okamoto et al. | 399/308 |
| 6,212,352 B1 | * | 4/2001 | Kagawa et al. | 399/307 |

FOREIGN PATENT DOCUMENTS

| | | |
|---|---|---|
| JP | 46-41679 | 12/1971 |
| JP | 62-280882 | 12/1987 |
| JP | 10-333366 | 12/1998 |

* cited by examiner

*Primary Examiner*—Sophia S. Chen
(74) *Attorney, Agent, or Firm*—Michael Best & Friedrich LLC; J. Warren Whitesel

(57) ABSTRACT

In an image forming apparatus, a latent image is formed on a rotatable photosensitive body and treated with a liquid developer containing a carrier solution and toner particles, whereupon a visible image is formed on the body. The visible image is transferred from the photosensitive body to a record medium through the intermediation of an intermediate transfer body. The transfer body has a surface that serves as a transfer medium. As the transfer medium is pressed against the body in a transfer position, the visible image is transferred from the photosensitive body to the transfer medium. At least one of the respective surface temperatures of the photosensitive body and the transfer medium is controlled such that $T1 \leqq Tg < T2$ is fulfilled where T1 and T2 are the surface temperatures of the photosensitive body and the transfer medium in the transfer position, respectively, and Tg is the glass transition point of the toner particles, and that the complex coefficient of viscosity of the toner particles at the temperature T2 is at 10,000 poises or more.

14 Claims, 2 Drawing Sheets

IMAGE FORMING METHOD AND APPARATUS

CROSS-REFERENCE TO RELATED APPLICATIONS

This application is based upon and claims the benefit of priority from the prior Japanese Patent Application No. 11-235669, filed Aug. 23, 1999, filed the entire contents of which are incorporated herein by reference.

BACKGROUND OF THE INVENTION

The present invention relates to an image forming method and apparatus, and more specifically, to a technique for controlling the respective surface temperatures of a transfer medium and a carrying body for holding a visible image thereon, thereby improving the transfer efficiency of the visible image.

A wet image forming apparatus, such as an electrophotographic or electrostatic recording apparatus, which uses a liquid developer, has the following advantages over a dry image forming apparatus in the main, and its new merits have recently been being discovered. The liquid developer can ensure high image quality, since it can be formed containing very fine toner particles of a submicron size. Further, satisfactory image density can be obtained with use of a small quantity of toner, so that high economical efficiency and texture of images as fine as that of printed matter (e.g., by offset printing) can be enjoyed. Since the toner can be fixed to paper at a relatively low temperature, furthermore, energy-saving can be realized.

On the other hand, the conventional wet image forming apparatus that uses the liquid developer involves some essential problems, and it has long been subordinate to the dry technique. Transfer means has one of these problems. Lowering of image quality is a first problem on transfer. Conventionally, a developer on a carrying body for holding a latent image thereon is transferred directly to paper by the agency of an electric field of the transfer means. Therefore, the transferred image is subject to unevenness that is attributable to field fluctuation caused by the irregularity of the surface of the paper. Further, transfer failure easily occurs due to variation in the electrical properties of the paper or dependence on the environment.

These problems lower the quality of transferred images considerably. In order to solve the problems, an apparatus is proposed such that a latent image is temporarily transferred from a carrying body for holding it thereon to an intermediate transfer medium, and then transferred to paper. Described in U.S. Pat. Nos. 5,148,222; 5,166,734; and 5,208,637 are apparatuses in which a latent image is transferred to paper by means of pressure (and heat) after it is transferred from a carrying body for holding it thereon to an intermediate transfer medium by means of an electric field.

Described in Jpn. Pat. Appln. KOKOKU Publication No. 46-41679 and Jpn. Pat. Appln. KOKAI Publication No. 62-280882, moreover, are apparatuses in which both image transfer to an intermediate transfer medium and image transfer to paper are carried out by using pressure (and heat) without using an electric field. It is relatively easy to form the intermediate transfer medium from a material that has a smooth surface and is subject to less variation or fluctuation in electrical resistance. Thus, the possibility of lowering of image quality can be made lower than in the case where an image is transferred directly to paper by means of an electric field.

Lowering of image quality is restrained if the image is transferred to the intermediate transfer medium by means of pressure and heat. Since the image is transferred to paper by means of heat and pressure according to this method, the problems that are peculiar to the case of field transfer cannot easily arise. However, these proposed apparatuses are still subject to the following practical problems.

With use of heat and pressure only, it is hard to transfer a toner image of a very low density on a latent image carrying body to the intermediate transfer medium or paper with a high efficiency. In other words, only those portions of an image which have somewhat high density and thick toner layers can be preferentially transferred with ease. Thus, it is hard to reproduce multistage gradation, whereby the image finally transferred to the paper is liable to have poor gradation.

BRIEF SUMMARY OF THE INVENTION

In an image forming apparatus designed to use a liquid developer and transfer an image by means of pressure, as mentioned above, multistage gradation cannot be reproduced with ease because the transfer efficiency for thin toner image portions is low, although the accuracy of the image can be improved.

The present invention has been made in consideration of these circumstances, and its object is to ensure high transfer efficiency for even thin toner image portions, in an image forming apparatus and method for transferring images by utilizing pressure.

According to a first aspect of the present invention, there is provided an image forming apparatus comprising:

- a carrying body configured to hold an electrostatic latent image thereon;
- a charger configured to charge the carrying body with electricity;
- a light source configured to selectively irradiate with light the carrying body charged by means of the charger, thereby forming the latent image on the carrying body;
- a developing unit configured to treat the latent image with a liquid developer containing a carrier solution and toner particles, thereby forming a visible image on the carrying body; and
- a pressure member configured to press a transfer medium against the carrying body in a transfer position, thereby transferring the visible image from the carrying body to the transfer medium,
  - wherein $T1 \leqq Tg < T2$ is fulfilled where T1 and T2 are surface temperatures of the carrying body and the transfer medium in the transfer position, respectively, and Tg is a glass transition point of the toner particles.

According to a second aspect of the present invention, there is provided an image forming apparatus comprising:

- a rotatable photosensitive body configured to hold an electrostatic latent image thereon;
- a charger configured to charge the photosensitive body with electricity;
- a light source configured to selectively irradiate with light a surface of the photosensitive body charged by means of the charger, thereby forming the latent image on the surface of the photosensitive body;
- a developing unit configured to treat the latent image with a liquid developer containing a carrier solution and toner particles, thereby forming a visible image on the surface of the photosensitive body; and
- an intermediate transfer body configure to intermediate transfer of the visible image from the surface of the photosensitive body to a record medium, the intermediate transfer body being pressed against the photosensitive body in a transfer position such that the visible image is transferred from the surface of the photosensitive body to a surface of the intermediate transfer body, wherein $T1 \leqq Tg < T2$ is fulfilled where T1 and T2 are surface temperatures of the photosensitive body and the intermediate transfer body in the transfer position, respectively, and Tg is a glass transition point of the toner particles, and a complex coefficient of viscosity of the toner particles at the temperature T2 is at 10,000 poises or more.

According to a third aspect of the present invention, there is provided an image forming method comprising:

charging with electricity a carrying body configured to hold an electrostatic latent image thereon;

selectively irradiating with light the charged carrying body, thereby forming the latent image on the carrying body;

treating the latent image with a liquid developer containing a carrier solution and toner particles, thereby forming a visible image on the carrying body; and pressing a transfer medium against the carrying body in a transfer position, thereby transferring the visible image from the carrying body to the transfer medium, wherein $T1 \leqq Tg < T2$ is fulfilled where T1 and T2 are surface temperatures of the carrying body and the transfer medium in the transfer position, respectively, and Tg is a glass transition point of the toner particles.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
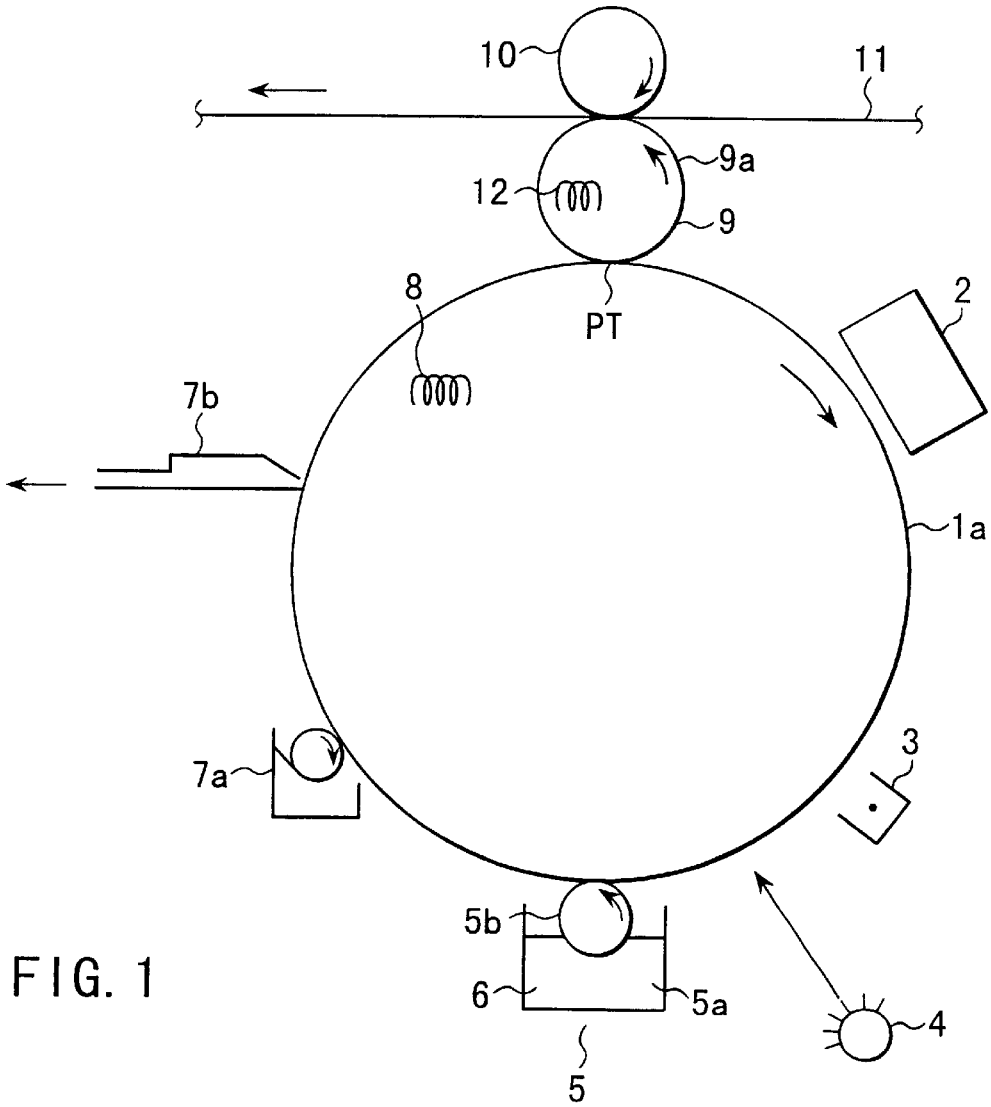
FIG. 1 is a sectional view schematically showing an image forming apparatus according to an embodiment of the present invention.

The present inventor conducted experiments on the transfer efficiencies of image forming apparatuses in which a visible image obtained by developing an electrostatic latent image with a liquid developer is pressed against a transfer medium and is transferred thereto. In this experiment, the transfer temperature and the type of the liquid developer were varied. Images were formed by using various liquid developers with the temperature of the transfer medium kept higher than that of a latent image carrying body, for example. Developers with satisfactory transfer efficiencies were extracted, and their properties were examined. In consequence, the following knowledge was obtained with respect to conditions for satisfactory transfer efficiencies.

The transfer efficiency can be improved even with use of a small quantity of a liquid developer (substantially equivalent to toner particles) for the formation of the visible image if a glass transition point Tg of the developer in a dry state and the respective surface temperatures of the latent image carrying body and the transfer medium are related as required. The transfer efficiency can be further improved if the surface temperature of the transfer medium is set such that the complex coefficient of viscosity is not lower than a given value when the liquid developer is dried at the surface temperature of the medium.

The following is a description of features of the present invention.

First, the glass transition point Tg of the dried liquid developer is higher than a surface temperature T1 of the latent image carrying body during transfer operation, and preferably, 5° C. or more higher than T1. In general, the adhesion of resin extremely lowers at a temperature below Tg. For satisfactory transfer efficiency, the adhesion on the interfaces between the surface of the latent image carrying body and the toner particles should ideally be as low as possible.

Secondly, Tg of the dried toner particles is lower than a surface temperature T2 of the transfer medium during transfer operation, and preferably, 5° C. or more lower than T2. During transfer operation, the adhesion between the toner and the transfer medium should preferably be as high as possible, and is expected to be at least higher than the adhesion between the latent image carrying body and the toner particles. As mentioned before, the adhesion of the resin drastically changes at Tg and tends to increase at temperatures higher than Tg.

Thirdly, the complex coefficient of viscosity of the toner particles at the surface temperature T2 of the transfer medium during transfer operation is at 10,000 poises or more. It is profitable to ensure high adhesion for the toner particles at the temperature T2. If the complex coefficient of viscosity of the toner particles at this temperature is too low, however, the fluidity of the toner particles themselves becomes too high, and the internal cohesive force is lowered, whereby the toner particles are liable to internal rupture. This state inevitably causes transfer failure.

Based on the knowledge described above, the present inventor made a diligent study and reached the following conclusions. First, in a wet electrophotographic system in which an image is transferred from a latent image carrying body to a transfer medium by means of pressure (pressure and heat, if necessary), preferable transfer characteristics can be obtained if the glass transition point Tg of the dried liquid developer fulfills $T1 \leqq Tg < T2$, where T1 and T2 are the respective surface temperatures of the latent image carrying body and the transfer medium during transfer operation. In this case, better transfer characteristics can be obtained if the complex coefficient of viscosity at the temperature T2 of the dried developer is 10,000 poises or more. At temperatures higher than Tg, the complex coefficient of viscosity of the toner particles normally lowers as the temperature increases. In this case, therefore, the temperature at which the complex coefficient of viscosity of the toner particles reaches 10,000 poises is equal to the upper limit value of T2.

Some embodiments of the present invention achieved on the basis of the finding given above will now be described with reference to the accompanying drawings. In the following description, the constituent elements having substantially the same function and arrangement are denoted by the same reference numerals, and a repetitive description will be made only when necessary. FIG. 1 is a sectional view schematically showing an image forming apparatus according to the embodiment of the present invention.

A carrying body 1 for holding a latent image thereon is formed of a rotatable photosensitive drum that is provided with a photosensitive layer 1*a* on the surface of its conductive base. A mold release layer with low surface energy may be formed on the surface of the layer 1*a*.

The surface of the carrying body 1 is charged with electricity uniformly to, e.g., 800V, by means of a charger 3. A conventional charger, such as a corona charger or a scorotron charger, may be used as the charger 3.

The charged carrying body 1 is moved to an exposure section, and is selectively irradiated with or exposed to light from a light source 4, which is modulated in accordance with image information. Thus, the irradiated portion is set at a potential of, e.g., 0 to 700V, and an electrostatic latent image is formed on the surface of the carrying body 1. A laser generator or the like may be used as the light source 4.

The electrostatic latent image formed on the surface of the carrying body 1 is visualized in a developing section by means of a developing unit 5. The developing unit 5 comprises a developer vessel 5*a*, which stores a liquid developer 6, and a developing roller 5*b* that is located close to the carrying body 1. As the roller 5*b* is rotated, the developer 6 in the vessel 5*a* is supplied to the carrying body 1. In order to visualize the latent image with the liquid developer, bias voltage is applied to the roller 5*b*. Thus, as the developing roller 5*b* is biased to, e.g., 600V, the liquid developer 6 is supplied to only the latent image that has a predetermined potential, whereupon a visible image is formed.

The liquid developer 6 is formed of a carrier solution and toner particles that is dispersed in the carrier solution. Normally, an insulating hydrocarbon solvent is used as the carrier solution, and the used toner particles contain at least a pigment and resin. If necessary, metallic soap may be added to the liquid developer.

The carrying body 1, having its surface developed with the liquid developer 6, moves to a carrier solution removing section in which a squeeze roller 7*a* is disposed. The roller 7*a* is arranged close to the carrying body 1 such that the surfaces of the roller 7*a* and the carrying body 1 facing each other move in directions opposite to each other. As a result, the carrier solution that is too much for the gap between the body 1 and the roller 7*a* is removed from the surface of the body 1. In this embodiment, the roller 7*a* rotates in the same direction (clockwise direction in FIG. 1) as the carrying body 1.

After the carrier solution removing section is passed, the surface temperature of the carrying body 1 is adjusted to a given value by means of first temperature control means or a thermal energy source (heating or cooling element) 8 that is located in the body 1. The heating or cooling element is suitably selected as the first temperature control means 8 in accordance with the glass transition point Tg of the toner particles used in the liquid developer 6. Only if the surface temperature of the photosensitive body in a transfer position PT (mentioned later) can be adjusted to a given value, the first temperature control means 8 may be located in any position in the image forming apparatus.

After these processes are finished, the carrying body 1, having the visible image thereon, moves to the transfer position PT. It is to be desired that the visible image in the transfer position PT should be dried to a degree such that it substantially contains no carrier solution. In the case where the temperature control means 8 is the heating element, the carrier solution in the visible image can be removed substantially thoroughly by heating. If the carrier solution cannot be removed entire due to low heating temperature or because the temperature control means 8 is the cooling element, however, it should be removed thoroughly by using drying means, such as a suction nozzle 7*b*, besides the squeeze roller 7*a*. Thus, the dried visible image is transported to the transfer position PT.

An intermediate transfer roller 9 is located in the transfer position PT so as to be pressed against the carrying body 1. The visible image is transferred from the carrying body 1 to a sheet 11, for use as a record medium, through the intermediation of the roller 9. More specifically, the visible image on the surface of the carrying body 1 is transferred temporarily to the transfer roller 9, and then transferred from the roller 9 to the sheet 11. To attain this, a pressure roller 10 is located over the intermediate transfer roller 9, and the sheet 11 is pressed against the roller 9 by means of the roller 10.

The intermediate transfer roller 9 includes a rigid roller body and an elastic layer 9*a* formed on the surface of the roller body. The surface of the layer 9*a* serves as a transfer medium. Thus, in the image forming apparatus shown in FIG. 1, the transfer roller 9 doubles as the transfer medium and a pressure member of the invention. In the transfer position PT, the surface of the transfer medium or the elastic layer 9*a* is pressed against the carrying body 1 under a pressure of 0.2 to 10 kg/cm.

As mentioned later, the intermediate transfer roller 9 is not an essential element, and the image can be transferred from the carrying body 1 to the sheet 11 directly in contact with each other. In this case, the sheet 1 or the record medium itself serves as the transfer medium according to the present invention.

The surface temperature of the intermediate transfer roller 9 is adjusted to a given value by means of second temperature control means or a thermal energy source (heating or cooling element) 12. The heating or cooling element is suitably selected as the second temperature control means 12 in accordance with the glass transition point Tg of the toner particles used in the liquid developer 6. Only if the temperature of the transfer medium in the transfer position PT can be adjusted to a given value, the second temperature control means 12 may be located in any position in the image forming apparatus.

After the visible image is transferred to the intermediate transfer roller 9, the carrying body 1 enters the next process for image formation. Prior to this, the residue of the liquid developer 6 may be removed by means of a cleaner 2, if necessary.

[Experimental Device]

An experimental device was prepared in a manner such that the image forming apparatus with the structure shown in FIG. 1 was set up in the following conditions.

A photosensitive drum of 150-mm diameter was used as the latent image carrying body 1, and it was rotated at a peripheral speed of 200 mm/sec. The photosensitive drum was provided with the organic photosensitive layer 1*a* on the surface of its conductive base, and a silicone-based hard coating layer with a thickness of about 1 μm and surface energy of 26 dyne/cm was formed on the surface of the layer 1*a*.

A corona charger available on the market was used as the charger 3, whereby the photosensitive body surface was charged with electricity to +600V. A laser beam from the light source 4 was applied to the photosensitive body, so that the potential of the irradiated portion for a solid image on the photosensitive body became +300V. The developing voltage of the developing unit 5 was set at +400V. Further, it was set such that no carrier solution would substantially remain in the visible image after the squeeze roller 7*a* and the suction nozzle 7*b* were passed.

A drum of 50-mm diameter was used as the intermediate transfer roller 9. The roller 9 was pressed against the carrying body 1 under a pressure of 50 kg per A4-width (about 2.5 kg/cm) and with a nip width of 4 mm. The transfer roller 9 was obtained by forming a urethane rubber layer 9*a* of 2-mm thickness and 30° hardness on the surface of an aluminum roller. A stainless-steel drum of 50-mm diameter was used as the pressure roller 10. The roller 10 was pressed against the transfer roller 9 under a pressure of 90 kg per A4-width (about 4.5 kg/cm) and with a nip width of 4 mm.

A thermal energy source, formed of a heating or cooling element, was suitably selected as the first and second temperature control means 8 and 12. Temperature control was carried out in a manner such that the thermal energy source was regulated so that the respective surface temperatures of the carrying body 1 and the intermediate transfer roller 9 in the transfer position PT were at any desired values.

[Evaluation of Transferability]

An experiment for evaluating transferability was conducted by using the experimental device. The efficiency of transfer from the carrying body 1 to the intermediate transfer roller 9 was visually determined. In TABLES 1 to 3,"◎" indicates a case where no residue was observed on the carrying body 1, "○" a case where a little amount of a residue was observed, "X" a case where a residue was able to be recognized at a glance, and "Δ" a case between "○" and "X".

In order to measure the respective surface temperatures of the carrying body 1 and the intermediate transfer roller 9 in the transfer position PT, moreover, contact-type thermocouples were arranged individually on the upper- and lower-stream sides of transfer position PT with respect to the direction of rotation. The respective surface temperatures of the carrying body 1 and the transfer roller 9 in the transfer position PT were obtained by taking an average of temperatures in positions before and after the position PT. In this experimental device, the thermocouples were located at distances of 1 cm from the transfer position PT.

[Preparation of liquid Developer]

In this experiment, three types of liquid developers were prepared. A common carrier solution (Isopar L (TM): Exxon Chemical Corporation) was used for the individual developers. Three types of toner particles of varied resin components with different Tg were dispersed into the carrier solution.

In order to obtain the three types of resins with different Tg, raw materials (monomers) were selected from lauryl methacrylate, lauryl acrylate, acrylic acid, stearyl methacrylate, stearyl acrylate, butyl methacrylate, butyl acrylate, ethyl methacrylate, ethyl acrylate, methyl methacrylate, methyl acrylate, vinyl acetate, and styrene. The selected raw materials (monomers) were polymerized to form acryl-ester-based copolymers with different Tg.

A copolymer with a predetermined Tg thus formed, and a pigment, a dispersant and the like were added to the carrier solution, and were mixed and dispersed under the presence of glass beads by means of a paint shaker. Thereupon, a condensed liquid developer was prepared. The condensed developer thus obtained was diluted with Isopar L (TM) produced by Exxon Chemical Corporation so that the non-volatile content was 1% by weight. Further, a zirconium naphthenate produced by Dainippon Ink And Chemicals Inc. was added to the diluted developer, so that the ratio between the nonvolatile content and the zirconium naphthenate was 2:1 by weight. The resulting liquid developer was regarded as a final product.

Cyanine Blue KRO (TM) produced by Sanyo Color Works, Ltd. was used as the pigment that was added to the toner particles. The mixture ratio between the resin and the pigment was 4:1 by weight. Thus, liquid developers 1, 2 and 3 were prepared to contain dispersed toner particles with dry-state Tg of −10° C., 15° C., and 45° C., respectively.

EXSTAR6000DSC (™) produced by Seiko Instruments Inc. was used to measure the glass transition point Tg. When two or more signals were observed, a signal corresponding to the highest or higher temperature was used as Tg.

RHIOS (™) produced by Rheometric Scientific Ltd. was used to measure the complex coefficient of viscosity. Column-type cells of 12-mm diameter were used with the gap of 0.5 mm and strain of ±0.025 radian.

TABLES 1 to 3 show evaluations on transfer with use of a toner 1 (Tg: −10° C.), toner 2 (Tg: 15° C.), and toner 3 (Tg: 45° C.), respectively.

TABLE 1

| | T1 (° C.) | T2 (° C.) | Complex Coefficient of Viscosity at T2 (poise) | Transferability |
|---|---|---|---|---|
| E10 | −20 | 25 | 20,000 | ○ |
| E11 | −20 | −20 | Unmeasurable | X |
| E12 | −20 | 40 | 7,500 | Δ |
| E13 | 15 | 25 | 20,000 | X |

TABLE 2

| | T1 (° C.) | T2 (° C.) | Complex Coefficient of Viscosity at T2 (poise) | Transferability |
|---|---|---|---|---|
| E20 | 10 | 150 | 5,000 | Δ |
| E21 | 10 | 120 | 8,000 | Δ |
| E22 | 10 | 50 | 150,000 | ○ |
| E23 | 10 | 25 | 1,000,000 | ◎ |
| E24 | 10 | 20 | 8,000,000 | ◎ |
| E25 | 10 | 10 | Unmeasurable | X |
| E26 | 15 | 25 | 1,000,000 | ○ |
| E27 | 25 | 50 | 150,000 | X |
| E28 | 50 | 50 | 150,000 | X |

TABLE 3

| | T1 (° C.) | T2 (° C.) | Complex Coefficient of Viscosity at T2 (poise) | Transferability |
|---|---|---|---|---|
| E30 | 25 | 150 | 2,000 | Δ |
| E31 | 25 | 120 | 8,000 | Δ |
| E32 | 25 | 50 | 1,200,000 | ⊙ |
| E33 | 25 | 25 | Unmeasurable | X |
| E34 | 45 | 60 | 200,000 | ⊙ |
| E35 | 50 | 60 | 200,000 | X |
| E36 | 50 | 50 | 1,200,000 | X |
| E37 | 70 | 50 | 1,200,000 | X |

As shown in TABLES 1 to 3, a large amount of a residue was recognized when T1 was higher than Tg (e.g., E13, E27, E28, E35, E36 and E37) and when T2 was not higher than Tg (e.g., E11, E25 and E33). A small amount of a residue was recognized when the complex coefficient of viscosity at T2 was lower than 10,000 poises (e.g., E12, E20, E21, E30 and E31). On the other hand, the transferability was satisfactory when all the conditions including $T1 \leqq Tg < T2$ and the complex coefficient of viscosity of the toner particles of 10,000 poises or more at T2 were fulfilled (e.g., E10, E22, E23, E24, E26, E32 and E34).

The transferability was particularly good when T1 was 5° C. or more lower than Tg, T2 was 5° C. or more higher than Tg, and the complex coefficient of viscosity of the toner particles at T2 was not lower than 100,000 poises. According to an additional experiment, a satisfactory result was obtained when an acryl-ester-based resin mixture was used as the resin for the toner particles of the liquid developer with Tg ranging from 30° C. to 60° C., preferably from 40° C. to 50° C.

Figure 2:
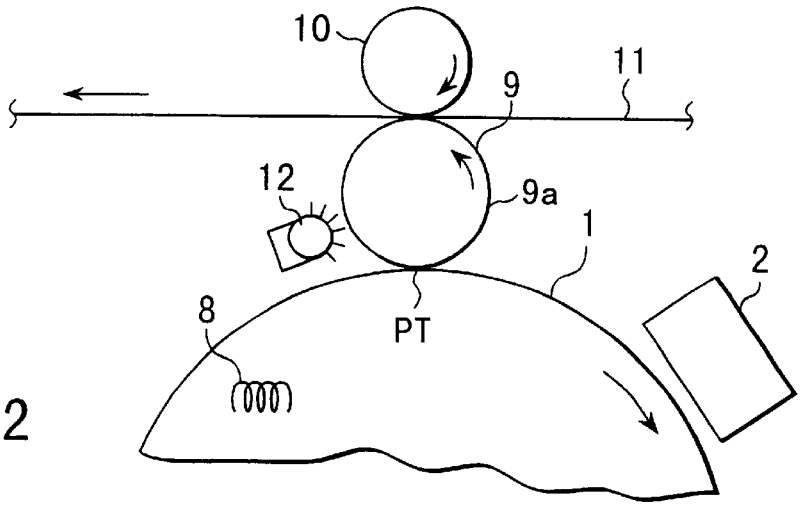
FIG. 2 is a view showing a modification of second temperature control means of the image forming apparatus shown in FIG. 1.

FIG. 2 is a view showing a modification of the second temperature control means 12 of the image forming apparatus shown in FIG. 1. In this modification, the second temperature control means 12 is provided with a light source for irradiating and heating the surface of the intermediate transfer roller 9. If necessary, the first temperature control means 8 may be constructed in the same manner. Thus, the first and second temperature control means 8 and 12 may be located outside the latent image carrying body 1 and the transfer roller 9 only if the respective surface temperatures of the carrying body and the transfer medium in the transfer position PT can be adjusted to the given values.

Figure 3:
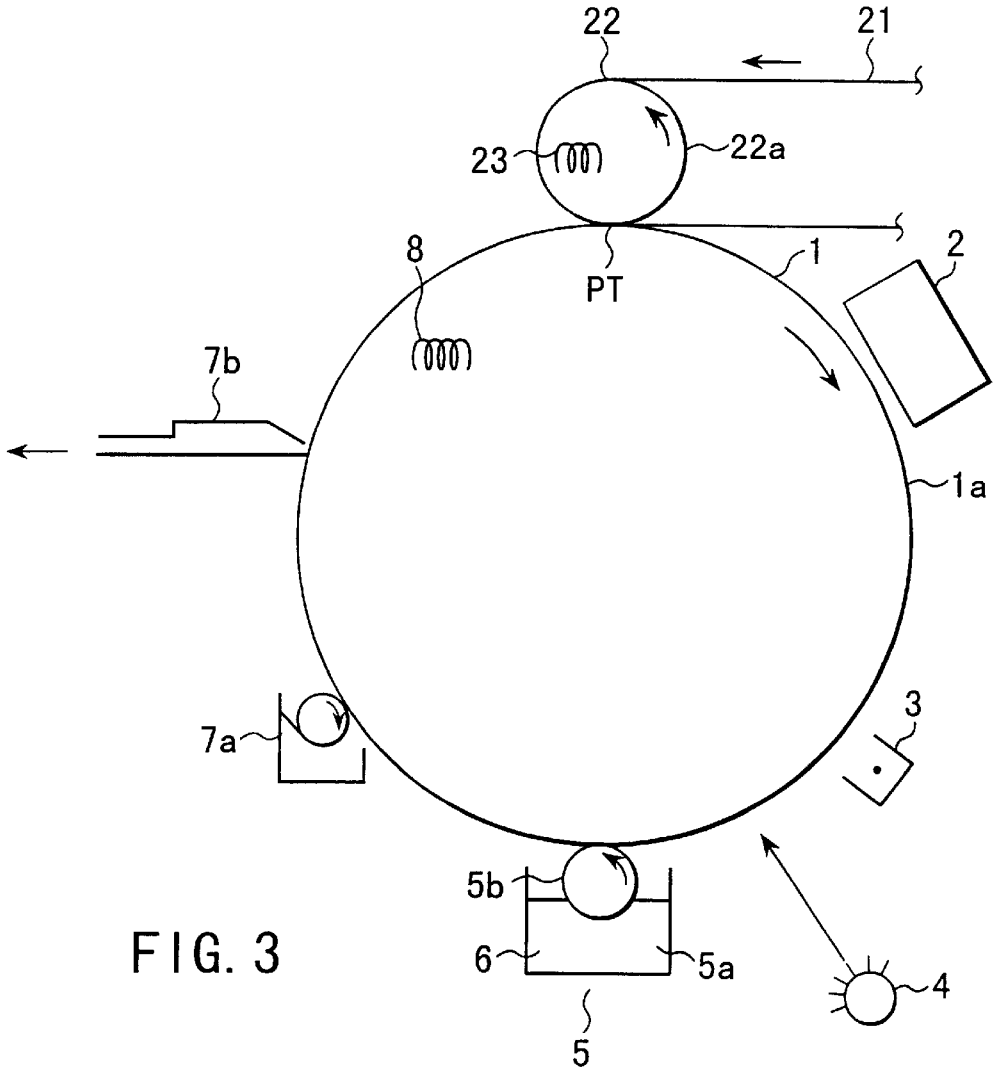
FIG. 3 is a sectional view schematically showing an image forming apparatus according to another embodiment of the invention.

FIG. 3 is a sectional view schematically showing an image forming apparatus according to another embodiment of the invention. According to this embodiment, a sheet 21 is pressed directly against a carrying body 1 in a transfer position PT by means of a pressure roller 22. In this case, the sheet 21 for use as a record medium itself serves as the transfer medium according to the present invention. The pressure roller 22 includes a rigid roller body and an elastic layer 22*a* formed on the surface of the roller body. To regulate the temperature of the sheet 21, second temperature control means or a thermal energy source (heating or cooling element) 23 is arranged in the pressure roller.

In this embodiment also, the first and second temperature control means 8 and 23 adjust the respective surface temperatures of the carrying body 1 and the sheet 21 in the transfer position PT so as to fulfill the conditions including $T1 \leqq Tg < T2$ and the complex coefficient of viscosity of the toner particles of 10,000 poises or more at T2. In this case, T1, T2 and Tg are the surface temperatures of the carrying body 1 and the sheet 21 in the transfer position PT, and the glass transition point of the toner particles, respectively. If the sheet 21 is thus pressed directly against the carrying body 1, the respective surface temperatures of the carrying body 1 and the sheet 21 in the transfer position PT can be suitably measured by means of a non-contact infrared temperature measuring device.

Figure 4:
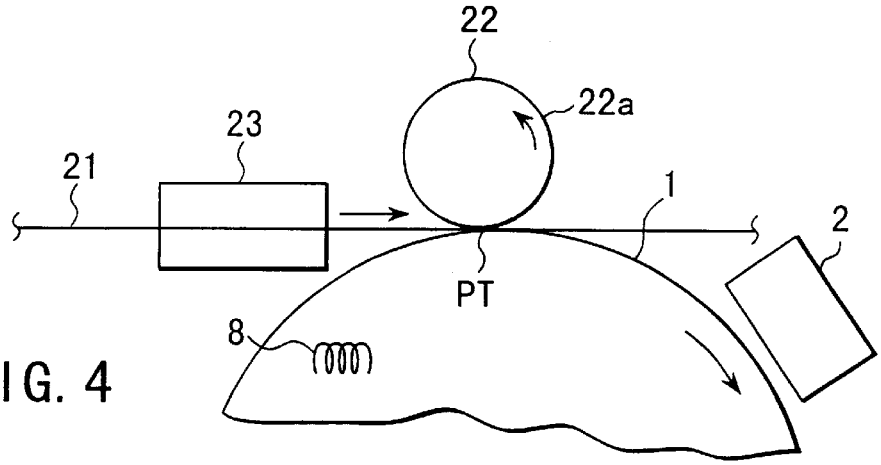
FIG. 4 is a view showing a modification of second temperature control means of the image forming apparatus shown in FIG. 3.

FIG. 4 is a view showing a modification of the second temperature control means 23 of the image forming apparatus shown in FIG. 2. In this modification, the second temperature control means 23 comprises a temperature regulator for previously adjusting the temperature of the sheet 21 to be delivered into the transfer position PT. Thus, the second temperature control means 23 may be also located in any position in the image forming apparatus only if the surface temperature of the sheet 21 or the transfer medium in the transfer position PT can be adjusted to the given value.

In the apparatuses shown in FIGS. 1 to 4, the carrying body 1, intermediate transfer roller 9, pressure roller 22, etc. are formed of a cylindrical member each. Alternatively, however, they be formed of a belt-shaped member each.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a carrying body configured to hold an electrostatic latent image on the carrying body;

a charger configured to charge the carrying body with electricity;

a light source configured to selectively irradiate with light the carrying body charged by means of the charger, and to form the latent image on the carrying body;

a developing unit configured to treat the latent image with a liquid developer containing a carrier solution and toner particles, and to form a visible image on the carrying body;

a pressure member configured to press a transfer medium against the carrying body in a transfer position, and to transfer the visible image from the carrying body to the transfer medium, wherein $T1 \leqq Tg < T2$ is fulfilled where T1 and T2 are surface temperatures of the carrying body and the transfer medium in the transfer position, respectively, and Tg is a glass transition point of the toner particles, a temperature control mechanism configured to control at least one of the respective surface temperatures of the carrying body and the transfer medium such that $T1 \leqq Tg < T2$ is fulfilled, and said temperature control mechanism being configured to control the surface temperature T2 of the transfer medium such that a complex coefficient of viscosity of the toner particles at the temperature T2 is at 10,000 poises or more.

2. The apparatus according to claim 1, wherein said pressure member comprises an intermediate transfer body configured to intermediate transfer of the visible image from the carrying body to a record medium, the transfer body having a surface capable of serving as the transfer medium.

3. The apparatus according to claim 2, further comprising said temperature control mechanism including first and second thermal energy sources arranged in the carrying body and the transfer medium, respectively.

4. The apparatus according to claim 2, further comprising said temperature control mechanism including a light source for irradiating the intermediate transfer body with light.

5. An image forming apparatus comprising:

a rotatable photosensitive body configured to hold an electrostatic latent image on the rotatable photosensitive body;

a charger configured to charge the photosensitive body with electricity;

a light source configured to selectively irradiate with light a surface of the photosensitive body charged by means of the charger, and to form the latent image on the surface of the photosensitive body;

a developing unit configured to treat the latent image with a liquid developer containing a carrier solution and toner particles, and to form a visible image on the surface of the photosensitive body; and an intermediate transfer body configured to intermediate transfer of the visible image from the surface of the photosensitive body to a record medium, the intermediate transfer body being pressed against the photosensitive body in a transfer position such that the visible image is transferred from the surface of the photosensitive body to a surface of the intermediate transfer body, wherein $T1 \leqq Tg < T2$ is fulfilled where T1 and T2 are surface temperatures of the photosensitive body and the intermediate transfer body in the transfer position, respectively, and Tg is a glass transition point of the toner particles, and a complex coefficient of viscosity of the toner particles at the temperature T2 is at 10,000 poises or more.

6. The apparatus according to claim 5, further comprising a temperature control mechanism configured to control at least one of the respective surface temperatures of the photosensitive body and the intermediate transfer body such that $T1 \leqq Tg < T2$ is fulfilled, and the complex coefficient of viscosity of the toner particles at the temperature T2 is at 10,000 poises or more.

7. The apparatus according to claim 5, wherein said temperature T1 is 5° C. or more lower than the point Tg, and said temperature T2 is 5° C. or more higher than the point Tg.

8. The apparatus according to claim 7, wherein said point Tg falls in a range of from 30° C. to 60° C.

9. An image forming method comprising:

charging with electricity a carrying body configured to hold an electrostatic latent image on the carrying body;

selectively irradiating with light the charged carrying body, and forming the latent image on the carrying body;

treating the latent image with a liquid developer containing a carrier solution and toner particles, and forming a visible image on the carrying body; and pressing a transfer medium against the carrying body in a transfer position, and transferring the visible image from the carrying body to the transfer medium, wherein $T1 \leqq Tg < T2$ is fulfilled where T1 and T2 are surface temperature of the carrying body and the transfer medium in the transfer position, respectively, and Tg is a glass transition point of the toner particles, and wherein, when transferring the visible image, a complex coefficient of viscosity of the toner particles at the temperature T2 is at 10,000 poises or more.

10. An image forming apparatus comprising:

a carrying body configured to hold an electrostatic latent image on the carrying body;

a charger configured to charge the carrying body with electricity;

a light source configured to selectively irradiate with light the carrying body charged by means of the charger, and to form the latent image on the carrying body;

a developing unit configured to treat the latent image with a liquid developer containing a carrier solution and toner particles, and to form a visible image on the carrying body; and a pressure member configured to press a transfer medium against the carrying body in a transfer position, and to transfer the visible image from the carrying body to the transfer medium, wherein $T1 \leqq Tg < T2$ is fulfilled where T1 and T2 are surface temperatures of the carrying body and the transfer medium in the transfer position, respectively, and Tg is a glass transition point of the toner particles, wherein said temperature T1 is 5° C. or more lower than the point Tg, and said temperature T2 is 5° C. or more higher than the point Tg, and wherein said point Tg falls in a range of from 30° C. to 60° C.

11. The apparatus according to claim 10, wherein said toner particles comprise an acryl-ester-based resin, and said point Tg is settled depending on the resin.

12. An image forming apparatus comprising:

a carrying body configured to hold an electrostatic latent image on the carrying body;

a charger configured to charge the carrying body with electricity;

a light source configured to selectively irradiate with light the carrying body charged by means of the charger, and to form the latent image on the carrying body;

a developing unit configured to treat the latent image with a liquid developer containing a carrier solution and toner particles, and to form a visible image on the carrying body; and a pressure member configured to press a transfer medium against the carrying body in a transfer position, and to transfer the visible image from the carrying body to the transfer medium, wherein $T1 \leqq Tg < T2$ is fulfilled where T1 and T2 are surface temperatures of the carrying body and the transfer medium in the transfer position, respectively, and Tg is a glass transition point of the toner particles, wherein said transfer medium is a record medium, and said pressure member includes a pressure roller such that the record medium is nipped between the pressure roller and the carrying body, and a temperature control mechanism includes first and second thermal energy sources arranged in the carrying body and the pressure roller, respectively.

13. The apparatus according to claim 12, further comprising said temperature control mechanism including a temperature regulator for previously adjusting the temperature of the record medium to be delivered into the transfer position.

14. An image forming method comprising:

charging with electricity a carrying body configured to hold an electrostatic latent image on the carrying body;

selectively irradiating with light the charged carrying body, and forming the latent image on the carrying body;

treating the latent image with a liquid developer containing a carrier solution and toner particles, and forming a visible image on the carrying body; and pressing a transfer medium against the carrying body in a transfer position, and transferring the visible image from the carrying body to the transfer medium, wherein $T1 \leqq Tg < T2$ is fulfilled where T1 and T2 are surface temperatures of the carrying body and the transfer medium in the transfer position, respectively, and Tg is a glass transition point of the toner particles, wherein said temperature T1 is 5° C. or more lower than the point Tg, and said temperature T2 is 5° C. or more higher than the point Tg, and wherein said point Tg falls in a range of from 30° C. to 60° C.

* * * * *